US009022614B2

(12) United States Patent
Chin-Huan

(10) Patent No.: US 9,022,614 B2
(45) Date of Patent: May 5, 2015

(54) INFLATABLE LAMP ASSEMBLY

(76) Inventor: Chien Chin-Huan, New Taipei (TW)

( * ) Notice: Subject to any disclaimer, the term of this patent is extended or adjusted under 35 U.S.C. 154(b) by 471 days.

(21) Appl. No.: 13/567,297

(22) Filed: Aug. 6, 2012

(65) Prior Publication Data

US 2013/0187569 A1 Jul. 25, 2013

(30) Foreign Application Priority Data

Jan. 20, 2012 (TW) ..... 101102650 A

(51) Int. Cl.

| | |
|---|---|
| ***F21V 7/00*** | (2006.01) |
| ***F21V 3/02*** | (2006.01) |
| ***F21V 23/04*** | (2006.01) |
| *F21S 9/02* | (2006.01) |
| *F21Y 101/02* | (2006.01) |
| *F21Y 113/00* | (2006.01) |

(52) U.S. Cl.

CPC ..... *F21V 3/026* (2013.01); *Y10T 428/13* (2015.01); *F21S 9/02* (2013.01); *F21V 23/0492* (2013.01); *F21Y 2101/02* (2013.01); *F21Y 2113/005* (2013.01); *F21V 23/0485* (2013.01)

(58) Field of Classification Search

USPC ..... 362/189, 307, 352

See application file for complete search history.

(56) References Cited

U.S. PATENT DOCUMENTS

| | | | | |
|---|---|---|---|---|
| 4,629,433 | A * | 12/1986 | Magid | 441/40 |
| 5,083,250 | A * | 1/1992 | Malcolm | 362/253 |
| 5,215,492 | A * | 6/1993 | Kubiatowicz | 446/219 |
| 6,238,067 | B1 * | 5/2001 | Hirsch | 362/352 |
| 7,036,958 | B2 * | 5/2006 | Hayne et al. | 362/352 |
| 7,147,536 | B1 * | 12/2006 | Hartelius | 446/220 |
| 7,478,779 | B2 * | 1/2009 | Nguyen et al. | 244/31 |
| 7,611,395 | B2 * | 11/2009 | Bonsembiante | 446/220 |
| 7,699,505 | B2 * | 4/2010 | Yang | 362/352 |
| 8,297,778 | B2 * | 10/2012 | Jeffrey | 362/189 |
| 8,789,981 | B2 * | 7/2014 | Harms et al. | 362/310 |
| 2006/0039138 | A1 * | 2/2006 | Oxborrow | 362/189 |
| 2006/0104070 | A1 * | 5/2006 | Carito | 362/398 |
| 2006/0141898 | A1 * | 6/2006 | Petell | 446/220 |
| 2006/0291217 | A1 * | 12/2006 | Vanderschuit | 362/363 |
| 2007/0167107 | A1 * | 7/2007 | Petell et al. | 446/220 |
| 2008/0032588 | A1 * | 2/2008 | Sun | 446/220 |
| 2008/0032589 | A1 * | 2/2008 | Sun | 446/220 |
| 2008/0032590 | A1 * | 2/2008 | Sun | 446/220 |
| 2008/0242190 | A1 * | 10/2008 | Hofer et al. | 446/220 |
| 2008/0291681 | A1 * | 11/2008 | Appleton | 362/307 |
| 2009/0191787 | A1 * | 7/2009 | Rubinstein | 446/220 |
| 2010/0041303 | A1 * | 2/2010 | Koonce et al. | 446/220 |
| 2010/0142209 | A1 * | 6/2010 | Cuppett et al. | 362/311.08 |
| 2012/0020076 | A1 * | 1/2012 | Leung | 362/235 |

(Continued)

FOREIGN PATENT DOCUMENTS

TW 69670 A1 8/1985

*Primary Examiner* — Adam Houston

(74) *Attorney, Agent, or Firm* — Chun-Ming Shih

(57) ABSTRACT

The present invention discloses an inflatable lamp assembly a bladder and a light emitting apparatus that assembled together. The bladder includes a first bag portion, a second bag portion connected with an opening of the first bag portion, an air nozzle disposed on the firs bag portion, and a flange disposed at the opening of the second bag portion. The first bag portion and the second bag portion are co-formed an inflatable cell which is capable of being inflated and deflated by the air nozzle. The light emitting apparatus is received in a recess defined between the second bag portion and flange. As such, the light emitting apparatus can be firmly clamped in the recess when the inflatable cell is filled with air.

12 Claims, 5 Drawing Sheets

(56) References Cited

U.S. PATENT DOCUMENTS

2012/0020090 A1* 1/2012 Tong ..... 362/249.16
2013/0187569 A1* 7/2013 Chin-Huan ..... 315/307
2014/0194232 A1* 7/2014 Krysiak et al. ..... 473/570
2014/0221137 A1* 8/2014 Krysiak et al. ..... 473/570
2014/0369525 A1* 12/2014 Lin ..... 381/107

* cited by examiner

INFLATABLE LAMP ASSEMBLY

BACKGROUND OF INVENTION

1. Field of Invention

From one aspect, the invention relates to a lamp assembly, and more especially to an inflatable lamp assembly. From another aspect, the invention relates to a bladder, and more especially to a bladder that can be assembled with a light emitting apparatus.

2. Related Prior Art

A conventional lamp cover is made of a transparent material, such as acrylic resin or glass. However, these types of the lamp cover is usually too big or too heavy to carry.

Taiwan Patent No. 69670 discloses an inflatable lamp cover that is easy to carry or to warehouse. The inflatable lamp further has a container melted with the bottom side of the lamp cover to accommodate a battery set therein for provide power to a lamp disposed in the lamp cover. The battery set is connected with the lamp cover by an embedded plate embedded in an opening of the container. However, it is quite inconvenient to assemble or detach.

SUMMARY OF INVENTION

The present invention discloses an inflatable lamp assembly, which has several advantages of conveniently assembling and detaching, as well as easily detaching the light emitting apparatus from the bladder.

In detail, the inflatable lamp assembly of the present invention comprises a bladder and a light emitting apparatus. The bladder includes a first bag portion, a second bag portion and an air nozzle. The second bag portion is connected with an opening of the first bag portion. The first bag portion and the second bag portion are co-formed an inflatable cell which is capable of being inflated and deflated. The air nozzle is disposed on the firs bag portion to inflate or deflate the inflatable cell. Besides, the bladder further comprises a flange disposed at the opening of the second bag portion facing the second bag portion, which allows the second bag portion to push toward the flange when the inflatable cell is inflated. The light emitting apparatus (or an object) is received in a recess formed between the second bag portion and flange. As such, the light emitting apparatus (or the object) can be firmly clamped in the recess when the inflatable cell is filled with air, and which can be easily detached from the recess when deflating.

As described above, the reason that the bladder can firmly clamp the light emitting apparatus when the inflatable cell is filled with air, as well as permit the light emitting apparatus to be easily detached when deflating, is difference between internal pressure and external pressure. Accordingly, the lamp assembly can achieve purposes of quickly, easily and conveniently detaching.

In addition, the light emitting apparatus comprises a light source, a control module and a G-sense. The G-sense is configured to sensor an acceleration of the bladder to generate a signal, and the control module controls brightness or emitting color of the light source according to the signal. In other words, selections of the light display modes, including the emitting color and/or the brightness of light beams, can be determined by touching or hitting the bladder to make the bladder move or shake. Thus, it is quite convenient to use this design. Alternately, the light source can be controlled to vary the emitting color and/or the brightness of light beams to provide special certain visual effect or warning effect. Furthermore, the first bag portion of the bladder has an inner wall and an outer wall, and the inner wall and/or the outer wall have textures formed thereon, which would increase diffusion effects to have the light gentle.

Other features, objects, aspects and advantages will be identified and described in detail below.

DETAILED DESCRIPTION OF EMBODIMENTS

Figure 1:
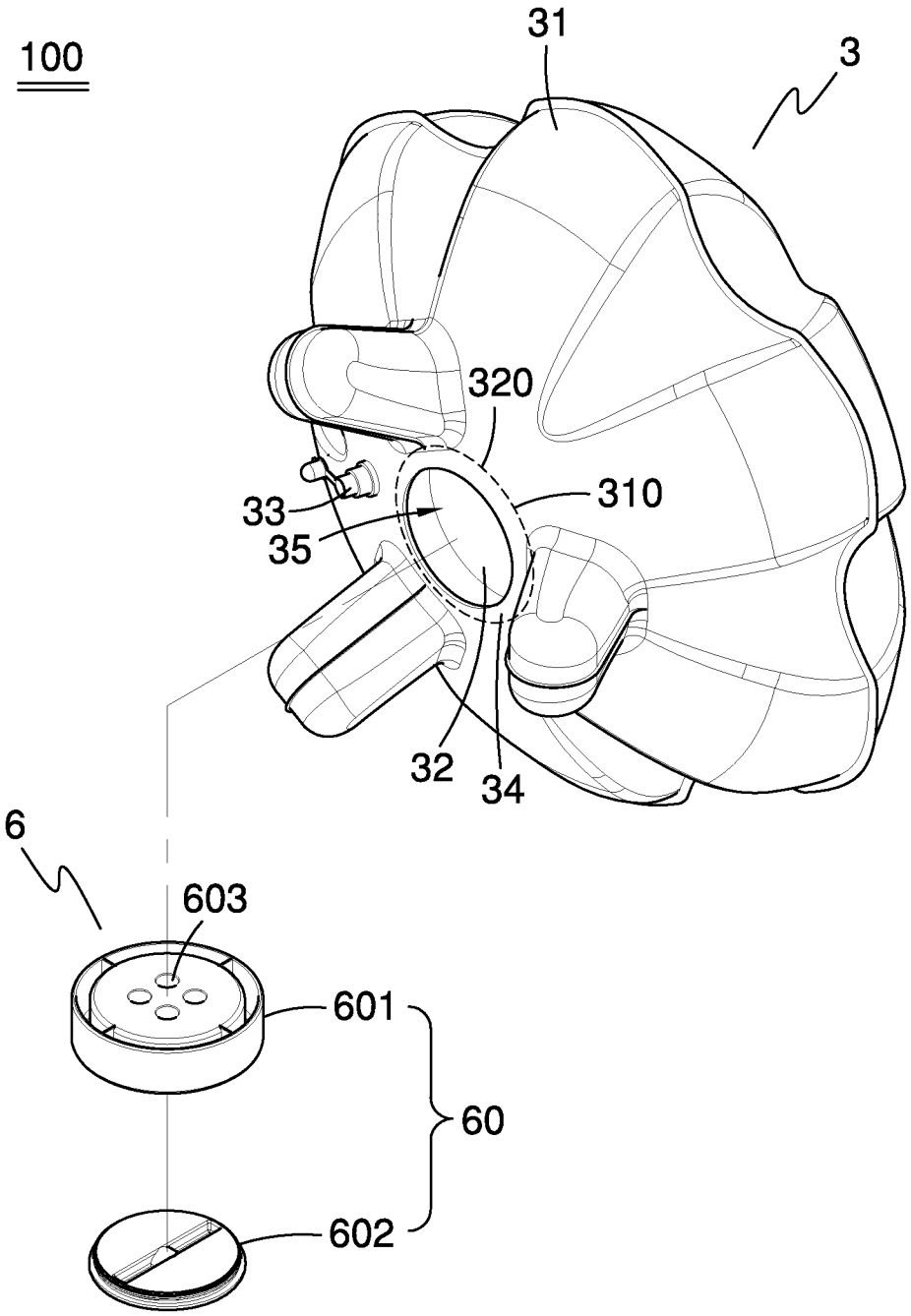
FIG. 1 is a perspective drawing showing an inflatable lamp assembly according to a first embodiment of the present invention.
Figure 2:
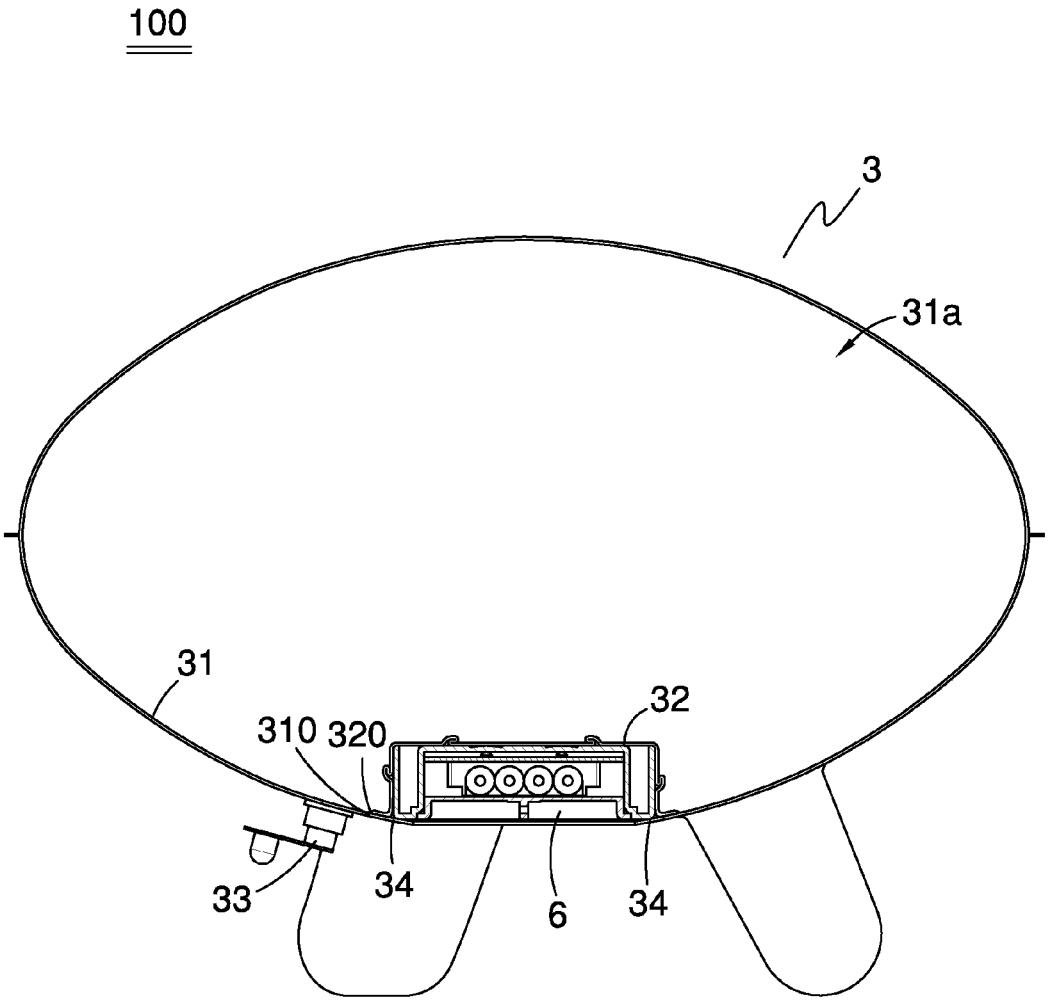
FIG. 2 is a perspective drawing showing an inflatable lamp assembly that assembled with a light emitting apparatus therein.
Figure 3:
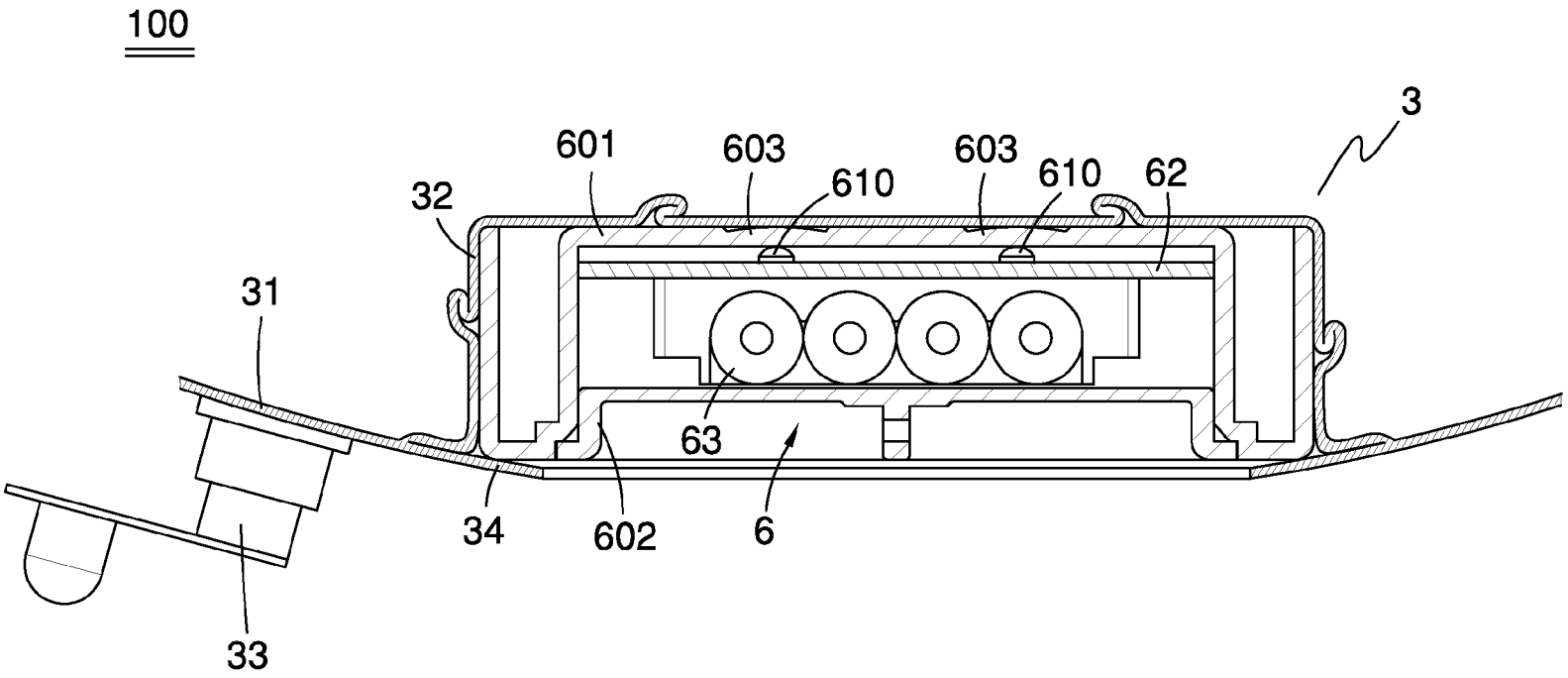
FIG. 3 is a partial enlarged cross sectional view of the inflatable lamp assembly of FIG. 2.

FIG. 1 to FIG. 3 are perspective drawings showing an inflatable lamp assembly (or called as a light floating assembly) according to a first embodiment of the present invention. As shown in FIG. 1 to FIG. 3, the inflatable lamp assembly 100 comprises a bladder 3, a light emitting apparatus 6 disposed in the bladder 3 and a G-sensor (not shown).

As shown in FIG. 2, the bladder 3 comprises a firs bag portion 31 (which is also named as outer bag portion), a second bag portion 32 (which is also named as inner bag portion) connected with the first bag portion 31 and an air nozzle 33. The first bag portion 31 and the second bag portion 32 are together formed an inflatable cell 31*a* for receiving air therein. The air nozzle 33 is disposed on the first bag portion 31 to provide inflate or deflate the inflatable cell 31*a*. Besides, the bladder 3 further comprises a flange 34 surrounding at periphery of an opening 320 of the second bag portion 32. The flange 34 is disposed at the opening 320 and faces the second bag portion 32 to allow the second bag portion 32 push toward the flange 34 when the inflatable cell 31*a* is inflated.

Figure 4:
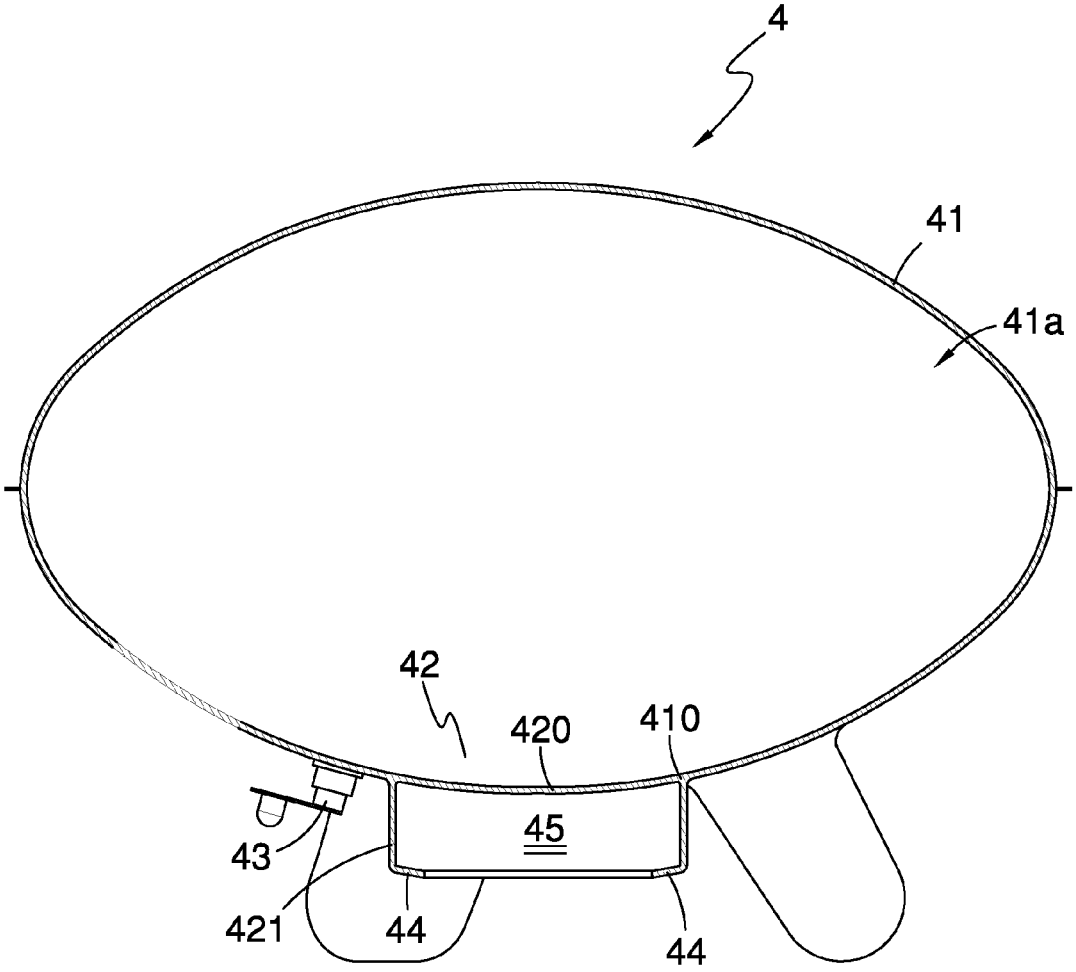
FIG. 4 is a perspective drawing showing a bladder according to another one embodiment of the present invention.

As depicted in this embodiment, the opening 320 of the second bag portion 32 is connected with an opening 310 of the first bag portion 31. In other words, size of the opening 310 of the first bag portion 31 is approximately equal to that of the opening 320 the second bag portion 32, such that the second bag portion 32 is able to dispose in the first bag portion 31 and seal together along their peripheries of openings 310 and 320. The first bag portion 31 and second bag portion 32 sealed with each other are defined the inflatable cell 31*a*. Alternately, in another embodiment, the second bag portion 42 of the bladder 4 as shown in FIG. 4 has a top wall 420 that completely sealed the opening 410 of the first bag portion 41. That is, the first bag portion 41 and the top wall 420 of the second bag portion 42 enclose an inflatable cell 41*a*. In addition, the bladder 4 comprises an air nozzle 43 and a flange 44. The air nozzle 43 is configured for inflating and deflating the inflatable cell 41*a*. The flange 44 extends from a sidewall 421 of the second bag portion 42 to define a recess 45 between the second bag portion 42 and flange 44. The recess 45 is provided to accommodate an object (not shown) therein, which allows the top wall 420 push the object toward the flange 44 to firmly clamp the object in the recess when the inflatable cell 41*a* is filled with air.

With reference to FIG. 1, the light emitting apparatus 6 is received in the recess 35 defined between the second bag portion 32 and the flange 34. As shown in FIG. 2, the second bag portion 32 is located inside of the first bag portion 31. In other words, the recess 35 is like a concave formed in the bladder 3. Accordingly, the lamp assembly 100 has an advantage of aesthetic appearance as a whole. Further, according to the present invention, the top surface and the four side surfaces of light emitting apparatus 6 can be pressed by the second bag portion 31 and thus firmly clamped therein.

With reference to FIGS. 1 and 3, the light emitting apparatus 6 comprises a casing 60, a light source 61 disposed in the casing 60, a control module 62 and several batteries 63 for supplying power to the light source 61. The casing 60 has a top surface 601 and a bottom surface 602. The light source 61 has four LEDs 610. Each of the LEDs 610 has three LED chips disposed therein, which respectively emits red light, green light and blue light. In other words, each of the LEDs 610 emits three types of light. The control module 62 is configured to control the brightness or emitting color of the LEDs 610. Specifically, the casing 60 is a transparent material which allows the light emitted from the LEDs 610 of the light source 61 to travel toward the inside of the inflatable cell 31*a*. Preferably, the top surface 601 of the casing 60 has four lens 603 integrally formed thereon and the four lens 603 are respectively formed on emitting positions of the casing 60 corresponding to the LEDs 610, which permits the light from the LEDs 610 to uniformly guide into the inflatable cell 31*a* by the secondary lens. More preferably, areas of the top surface 601, excluding the areas of the four lenses 603, are matte surface, which enables the light to focus on the casing 60 itself. Besides, the first bag portion 31 of the bladder 3 has an inner wall and outer wall. The inner wall and/or outer wall have textures formed thereon, which would increase diffusion effects to have the light gentle.

The G-sensor (not shown) is configured to sense a collision of the bladder 3 or an acceleration of the bladder 3 to generate a signal, and the control module 62 is configured to control brightness or emitting color of the LEDs 610 according to the signal from the G-sensor. Further specifically, the control module 62 is configured to receive a first signal generated from the G-senor to enable the light source 61 to emit a plurality of light beams in different colors or different brightness in sequence, and a second signal generated from the G-sensor to enable the light source 61 to emit the light in certain color or brightness according to the demand. For example, the control module 62 firstly receives a signal (such as a first signal representing emitting various lights with different colors or different brightness in sequence) from the G-sensor at the first time to control the light source 61 to display a plurality of light beams in different colors or different brightness in sequence, which offers several choices to a user. This shows that the first signal contains information of several display modes with light beam in different color or brightness at the first time, such as emitting red light, blue light, green light and etc. When the desired light beam in certain color (and/or certain brightness), such as red light beam, is displayed at the second time, all users has to do is to touch or hit the bladder 3. At this time, the G-sense will sense an acceleration of the bladder 3, and therefore generate a signal (i.e. a second signal representing stopping emitting various lights). The control module 62 then controls the light source 61 to stop and just to emit the current light beam, i.e. red light beam according to the second signal. This means that the light source 62 is controlled to stop at the current display mode with the selected light beam which is chose by the user. As such, the emitting color of light beams can be determined by touching or hitting the bladder. Similarly, selection of the light display modes can includes different selections of variable brightness, such as full brightness mode, gray brightness mode or black brightness mode.

Figure 5:
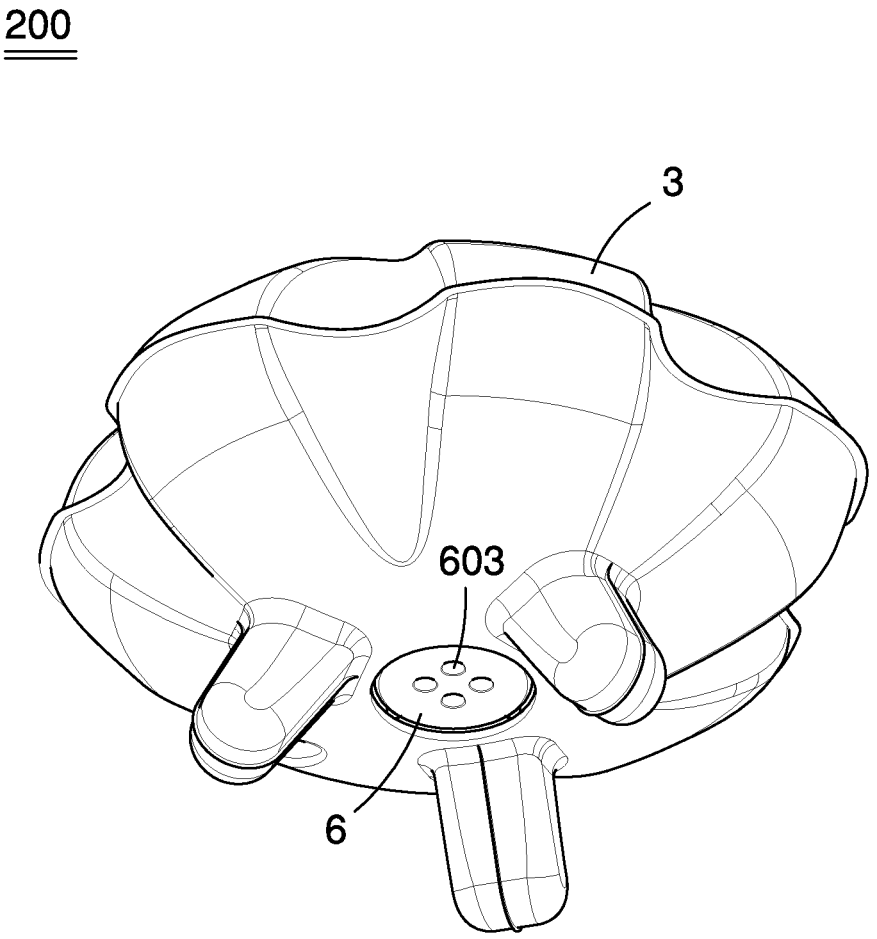
FIG. 5 is a perspective drawing showing an inflatable lamp assembly according to a second embodiment of the present invention.

FIG. 5 is a perspective drawing showing an inflatable lamp assembly 200 according to a second embodiment of the present invention. Differences from the above mentioned embodiment includes that the light emitting apparatus 6 is reversely disposed in the recess. Which shows that the light emitting side of the light emitting apparatus 6, i.e. the side where the lens 603 positioned, faces outside of the bladder 3, and the light emitting apparatus 6 directly project light toward outside of the bladder 3, that does not project light toward inside of the bladder 3. This configuration can be applicable to a water lamp or an aquarium.

It will be appreciated that although a particular embodiment of the invention has been shown and described, modifications may be made. It is intended in the claims to cover such modifications which come within the spirit and scope of the invention.

The invention claimed is:

1. A bladder comprising:

a first bag portion;

a second bag portion, connected with an opening of the first bag portion, the first bag portion and the second bag portion co-formed an inflatable cell, the inflatable cell being capable of being inflated and deflated;

an air nozzle, disposed on the first bag portion for inflating and deflating the inflatable cell; and a flange, disposed at an opening of the second bag portion and facing the second bag portion, the second bag portion being capable of pushing toward the flange when inflating the inflatable cell.

2. The bladder of claim 1, wherein the first bag portion has an inner wall and an outer wall, and the inner wall and/or the outer wall have textures formed thereon.

3. The bladder of claim 1, wherein the second bag is disposed in the first bag.

4. A lamp assembly comprising:

a bladder, comprising:

a first bag portion;

a second bag portion, connected with an opening of the first bag portion, the first bag portion and the second bag portion co-formed an inflatable cell, the inflatable cell being capable of being inflated and deflated;

an air nozzle, disposed on the first bag portion for inflating and deflating the inflatable cell; and a flange, disposed at an opening of the second bag portion and facing the second bag portion to form a recess between the flange and the second bag; and a light emitting apparatus, received in the recess, wherein the second bag portion is capable of pushing light emitting apparatus toward the flange when inflating the inflatable cell.

5. The lamp assembly of claim 4, wherein the first bag portion has an inner wall and an outer wall, and the inner wall and/or the outer wall have textures formed thereon.

6. The lamp assembly of claim 4, wherein the second bag is disposed in the first bag.

7. The lamp assembly of claim 4, wherein the light emitting apparatus comprises a casing and a light source disposed in the casing, and wherein the light source is disposed at a side facing the inflatable cell to permit light emitted from the light source to travel toward the inflatable cell.

8. The lamp assembly of claim 7, wherein the casing has a lens formed on a light-emitting position corresponding to the light source.

9. The lamp assembly of claim 4, wherein the light emitting apparatus comprises a light source and a control module that controls brightness or emitting color of the light source.

10. The lamp assembly of claim 9, further comprising a G-sensor, wherein the G-sensor is configured to sensor an acceleration of the bladder to generate a signal, and the control module controls brightness or emitting color of the light source according to the signal.

11. The lamp assembly of claim 10, wherein the control module is configured to receive a first signal from the G-sensor to control the light source to emit a plurality of light beams in different colors or different brightness in sequence, and a second signal from the G-sensor to control the light source to emit the light in the desired color or brightness.

12. A floating assembly, comprising:

a bladder, having an air nozzle:

a G-sensor, disposed in the bladder, the G-sensor configured to sensor an acceleration of the bladder to generate a signal; and a light emitting apparatus, disposed in the bladder and having a light source and a control module, wherein the control module controls brightness or emitting color of the light source according to the signal.

* * * * *